US006066053A

United States Patent [19]

Sehemberger

[11] Patent Number: 6,066,053

[45] Date of Patent: May 23, 2000

[54] ROLLER PUTTER

[76] Inventor: James W. Sehemberger, 10366 N. 48th St., Battle Creek, Mich. 49017

[21] Appl. No.: 09/276,414

[22] Filed: Mar. 25, 1999

Related U.S. Application Data

[60] Provisional application No. 60/080,033, Mar. 30, 1998.

[51] Int. Cl.[7] ..... A63B 69/36; A63B 53/04

[52] U.S. Cl. ..... 473/230; 473/251; 473/330; 473/340

[58] Field of Search ..... 473/230, 219, 473/244, 245, 324, 330, 313, 340, 341, 231, 226, 251; D21/736–746; 15/230.11; 492/13

[56] References Cited

U.S. PATENT DOCUMENTS 1,219,417 3/1917 Vories .
2,426,274 8/1947 Krmaer .
3,044,781 7/1962 Murphy .
3,060,555 10/1962 Kirshenmaum .
5,362,056 11/1994 Minotti .
5,577,965 11/1996 Burgess .

*Primary Examiner*—Sebastiano Passaniti
*Attorney, Agent, or Firm*—Frank A. Lukasik

[57] ABSTRACT

The invention is directed to a roller putter secured to a golf club shaft. The hitting surface is a cylinder, rotatably mounted on two roller bearings, fastened to a bottom portion of a hosel, and the cylinder has two "O" rings mounted in two grooves formed around the periphery of the cylinder, the "O" rings defining a "sweet spot" area for hitting the golf ball and two lines for sighting the roller head with the desired path of the struck golf ball.

1 Claim, 7 Drawing Sheets

ROLLER PUTTER

This is a Continuation of Provisional Application Ser. No. 60/080,033, Filed Mar. 30, 1998.

BACKGROUND OF THE INVENTION

Field of the Invention

The invention relates to a putter, and more specifically, the invention relates to a putter with the club head in the shape of a cylinder.

SUMMARY OF THE INVENTION

The invention consists of a unique concept in the design of the club head. This club head is in the shape of a cylinder. The cylinder is movable in the aspect that it rolls if the club head remains in contact with the ground. The roller is mounted to the hosel. The use of ball bearings at both ends of the roller head makes it possible for the club head to roll while remaining attached to the hosel.

The roller putter can be an effective training device for putting because it helps the user to focus on a straight consistent line for the club head to travel through in the putting stroke. The putter also helps the user to focus on the putting stroke and how it is affected by the proper arm swing. By keeping the putter in contact with the ground, it forces the golfer to generate the golf swing from the shoulders and not from any other part of the body, which is considered to produce a more accurate attempt.

In golf, as in many other sports, muscle memory is an integral part of a successful performance. When the muscles are trained to perform a stroke that is considered "in good form" the chances of success are greater. By keeping the roller putter in contact with the ground, it forces the user to exhibit the qualities of an accurate putting stroke. It also forces the club to travel in a straight line, which will produce a more accurate shot. By using and practicing with the roller putter over and over, muscle memory takes over and will determine the success regardless of whether the roller putter is being used or if one of a more conventional type is used.

In the game of golf, the object is to complete the hole/course in as few strokes as possible using the roller putter in competition will help the user with that objective. It is true that a golfer can become very accurate with a putter that they practice and become comfortable with, however, the roller putter makes it easier to maintain a straight line in the putting stroke, which, in turn, will help the golfer make a more accurate attempt, which will heighten the chances of a lower score for the golfer. The main advantage to the use of the roller putter is to lower one's golf score through practice of a consistent swing and for use in competition.

DETAILED DESCRIPTION OF THE PREFERRED EMBODIMENTS

Figure 1:
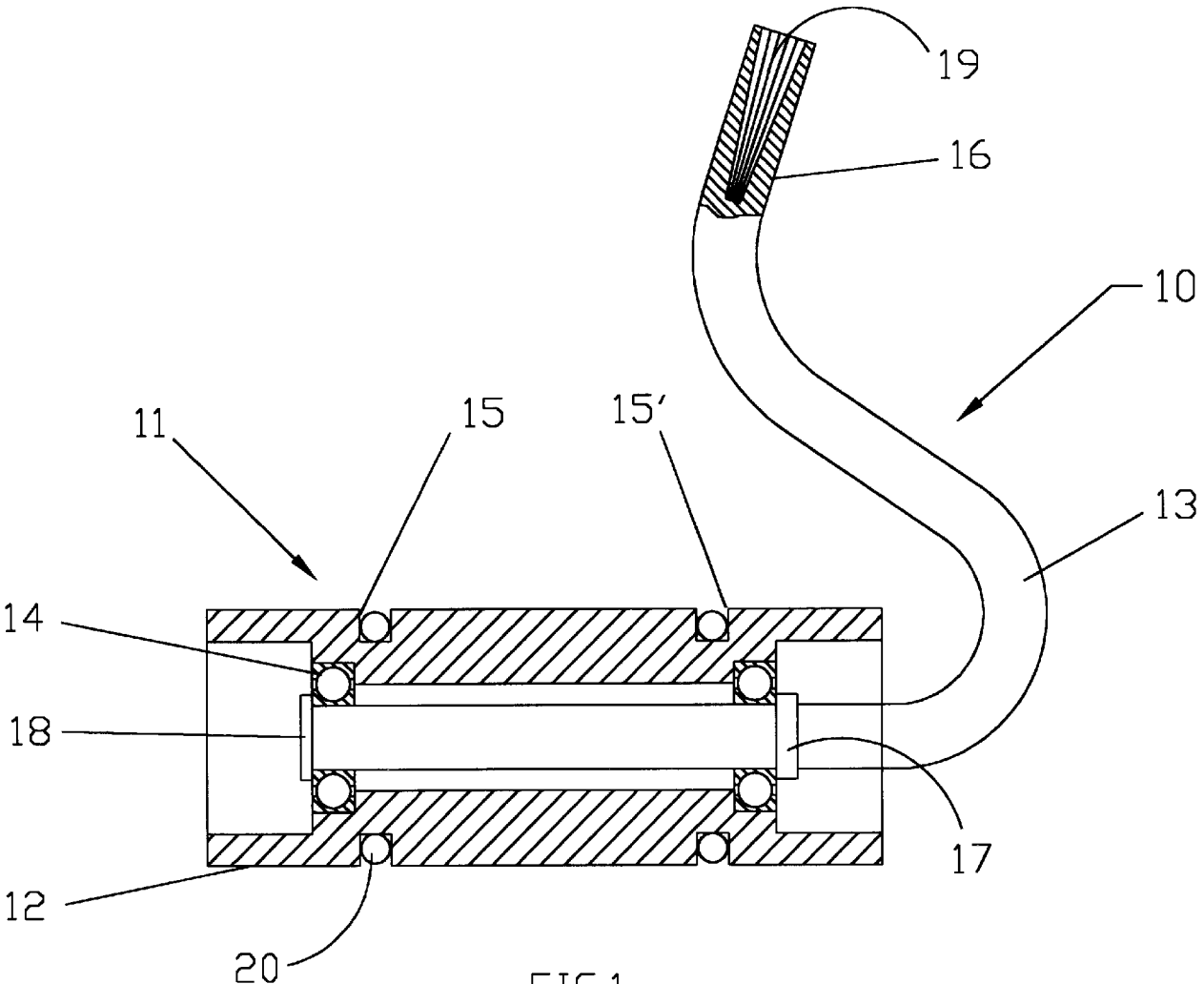
FIG. 1. is a side, sectional view of the roller putter in accordance with the invention.

FIG. 1 is a sectional view of the roller putter 10. The hosel 13 is inserted through the center of the cylinder 12 which is rotatatably mounted on hosel 13 with bearings 14 at opposite ends of the cylinder 12. This assembly enables the cylinder 12 (club head) to roll and not be fixed to the hosel 13.

Figure 2:
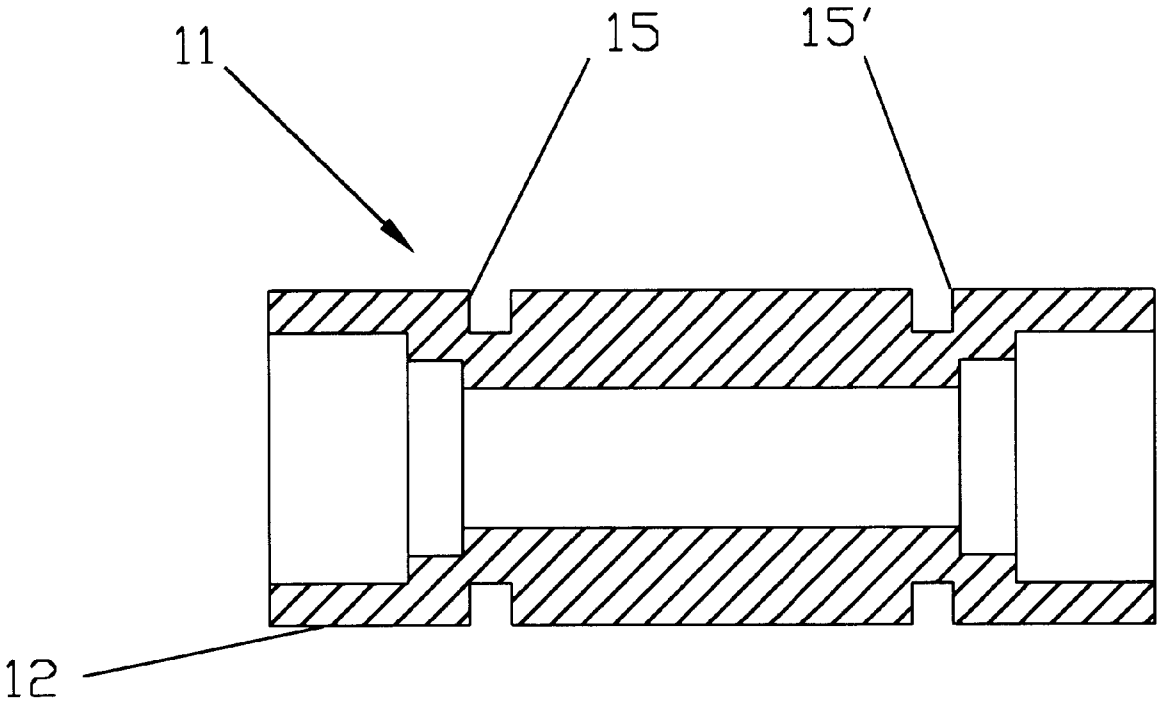
FIG. 2. is a side sectional view of the roller in accordance with the invention.
Figure 7:
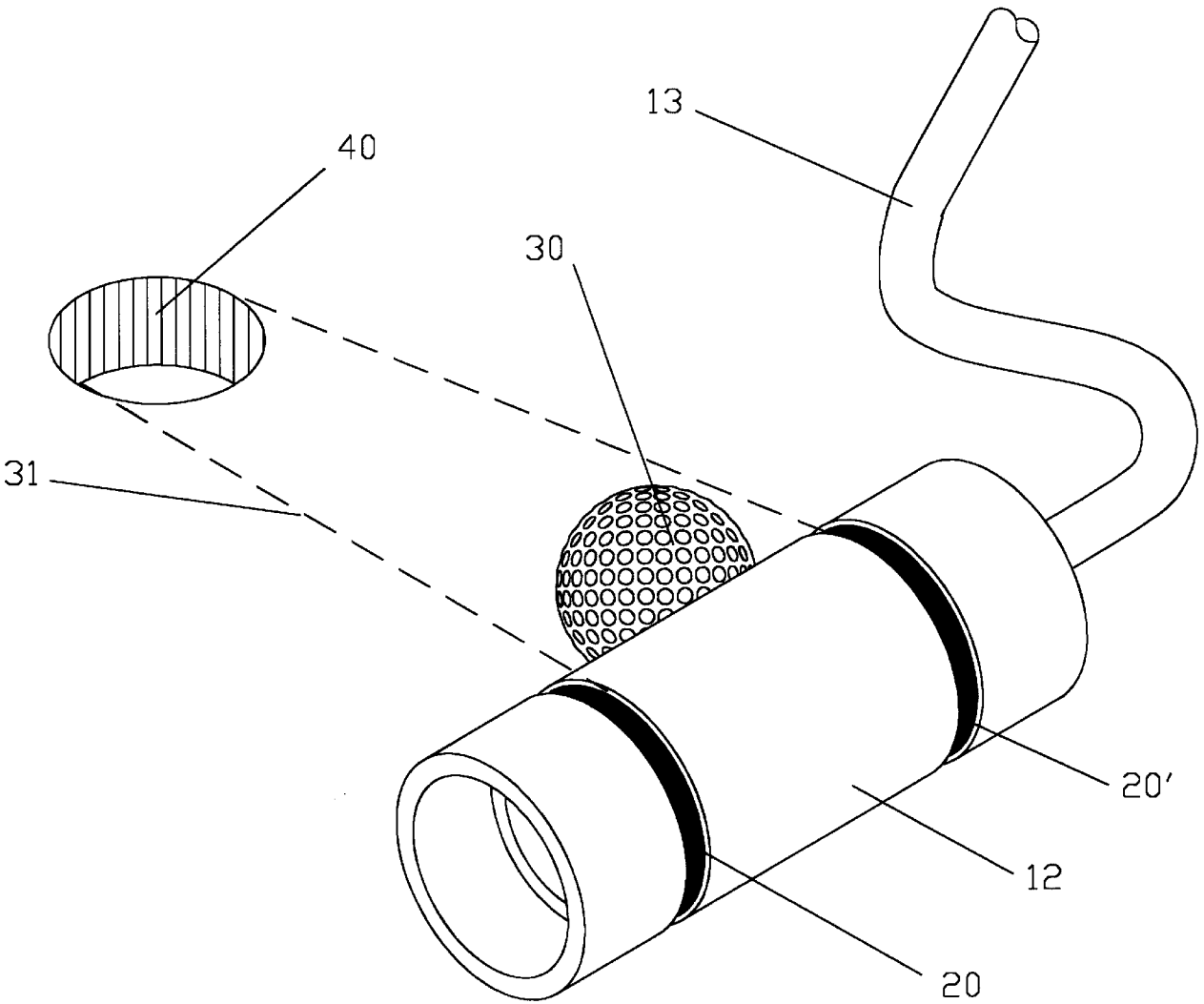
FIG. 7 is a top perspective view of the roller putter lined up with the golf ball in accordance with the invention.

FIG. 2 shows the club head 11, cylinder 12, in section. The cylinder 12 has two grooves 15 and 15' formed around the periphery. FIG. 2 also shows the internal dimensions needed to house the ball bearings 14 and for the hosel 13 to pass through. The grooves 15 and 15' are used to hold "O" rings 20 and 20' in place. The "O" rings 20 and 20' are spaced apart sufficiently to provide a "sweet spot", the area of the putter 10, which is the best area to hit the ball 30 and to also be used as a sighting line to line up the putter 10 with the path 31 to the hole 40, as shown in FIG. 7.

Figure 3:
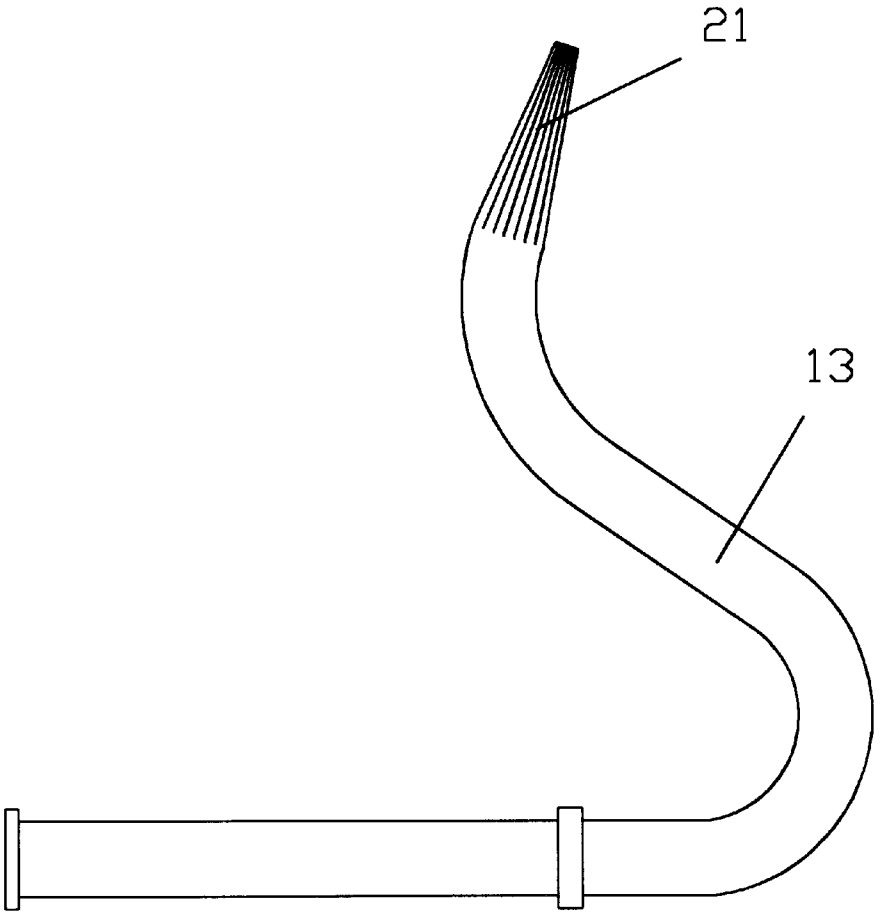
FIG. 3. is a side view of the hosel in accordance with the invention.
Figure 4B:
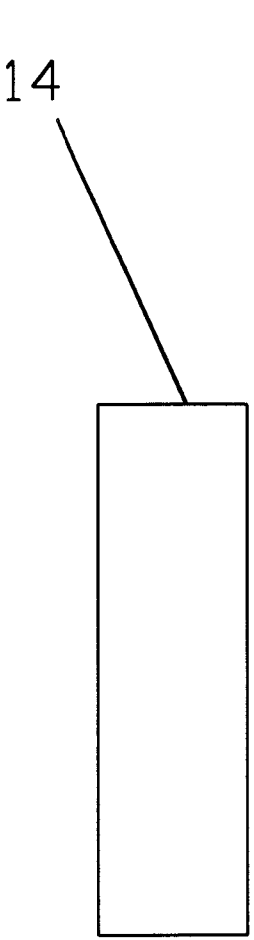
FIG. 4B. is an end view of the roller bearing in accordance with the invention.
Figure 4A:
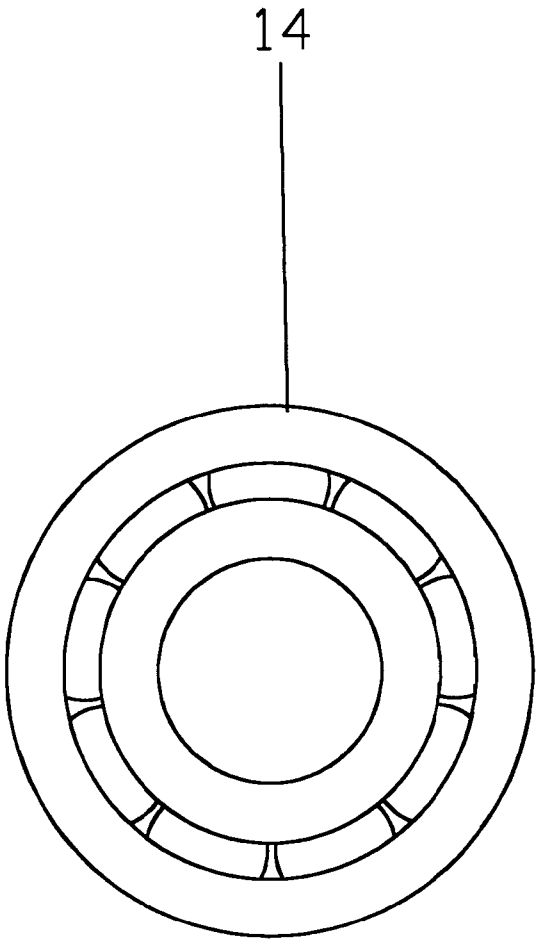
FIG. 4A. is a side view of the roller bearing in accordance with the invention.
Figure 4:
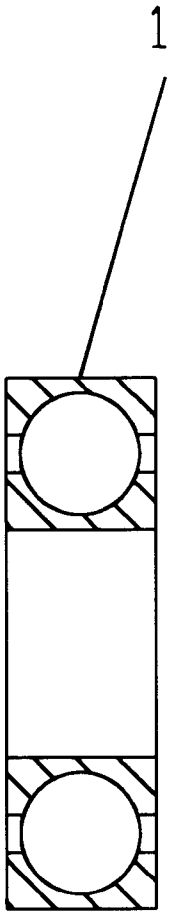
FIG. 4. is a sectional end view of the roller bearing, in accordance with the invention.
Figure 5:
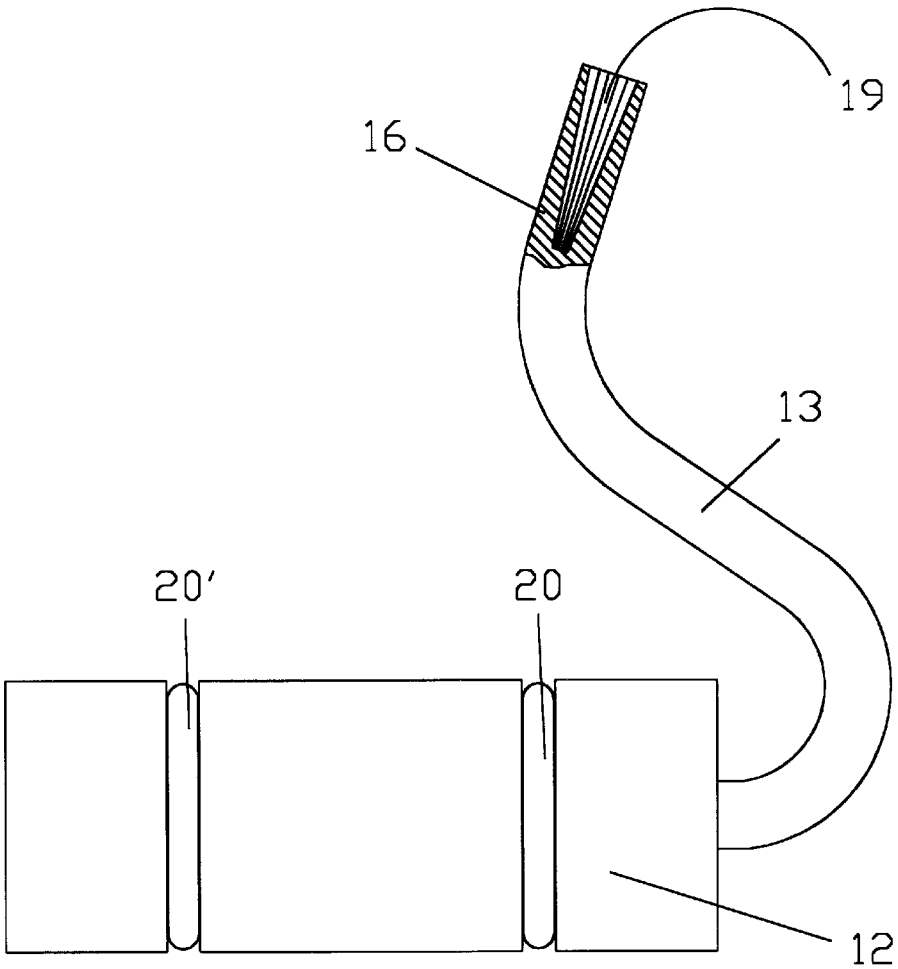
FIG. 5. is a side view of the roller putter with the hosel partly in section.
Figure 6:
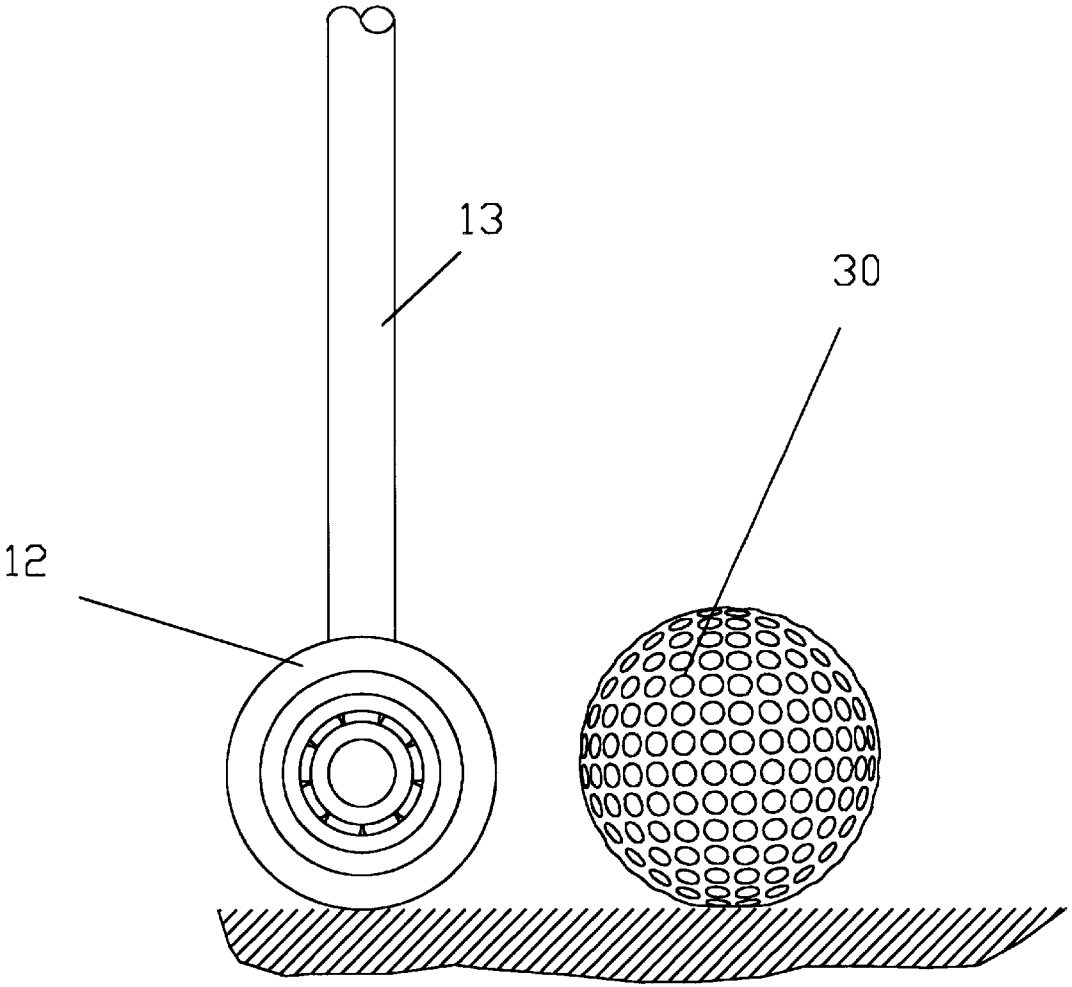
FIG. 6. is a side view showing the roller putter prior to hitting a golf ball in accordance with the invention.

FIG. 3 shows the detailed shape of the hosel 13. FIG. 1 shows the mounting portion 16 of the hosel 13 formed with a tapering hole 19 formed at the top 16 to hold a golf club shaft (not shown). FIG. 3 shows the top 16 having a tapered outer surface 21 as an alternative embodiment. Hosel 13 is formed with a shoulder 17 to retain the bearing 14 in position on the first end. A fastener 18 is used at the end opposite the shoulder 17 to fix the rollers 14 and cylinder 12 in a rotatable position on the hosel 13.

Thus it will be appreciated that the present invention provides a novelty device consisting of a putter with the club head shaped in the shape of a cylinder. It is contemplated that other embodiments and/or modifications may be made in the present invention without departure from inventive concepts manifested by the disclosed embodiments. It is expressly intended, therefore, that the foregoing description is illustrative only of preferred embodiments, not limiting, and that the true spirit and scope of the invention be determined by reference to the appended claims.

What is claimed is:

1. A golf club head adapted to be secured to a club shaft and consisting of:

a hosel having a top portion and a bottom portion, said hosel being formed in an "S" shape, said top portion being adapted to attach a club shaft, said hosel bottom portion having a first end and a second end, a shoulder formed on said hosel first end and a fastener affixed to said hosel second end, a roller bearing mounted on each of said said first and second ends of said hosel and held in place by said shoulder and said fastener, a cylinder having an internal cavity and an external surface, said cylinder being positioned on said roller bearings and being held in position by said roller bearings, said cylinder having two grooves formed around said external surface, said grooves defining a preferred hitting area on said cylinder, and an "O" ring inserted in each of said cylinder grooves, said "O" rings forming a sighting line on said cylinder for lining up said cylinder with the desired path of a golf ball struck by said cylinder.

* * * * *